US009731885B2

(12) United States Patent
Liao et al.

(10) Patent No.: US 9,731,885 B2
(45) Date of Patent: Aug. 15, 2017

(54) AIRTIGHT SHEATH

(71) Applicants: Tai-An Liao, New Taipei (TW); Kao-Hsiung Liao, New Taipei (TW)

(72) Inventors: Tai-An Liao, New Taipei (TW); Kao-Hsiung Liao, New Taipei (TW)

( * ) Notice: Subject to any disclaimer, the term of this patent is extended or adjusted under 35 U.S.C. 154(b) by 0 days.

(21) Appl. No.: 14/929,419

(22) Filed: Nov. 2, 2015

(65) Prior Publication Data

US 2017/0121093 A1 May 4, 2017

(51) Int. Cl.
*B65D 81/05* (2006.01)

(52) U.S. Cl.
CPC ..... *B65D 81/052* (2013.01)

(58) Field of Classification Search
CPC .... B65D 81/052; B65D 81/05; B65D 81/053; B65D 81/051
USPC ..... 206/522, 583, 586, 453, 454; 383/3
See application file for complete search history.

(56) References Cited

U.S. PATENT DOCUMENTS 7,066,331 B2 * 6/2006 Koyanagi ..... B65D 81/052 206/522
2002/0064319 A1 * 5/2002 Tanaka ..... B65D 33/02 383/3
2004/0149618 A1 * 8/2004 Otaki ..... B65D 81/052 206/521
2005/0109656 A1 * 5/2005 Ishizaki ..... B65D 81/052 206/522
2005/0263425 A1 * 12/2005 Tanaka ..... B65D 81/052 206/522
2007/0054655 A1 * 3/2007 Fantini ..... H04L 63/0853 455/411
2013/0129259 A1 * 5/2013 Liao ..... B65D 81/052 383/3
2015/0259121 A1 * 9/2015 Liao ..... B65D 81/05 206/521

* cited by examiner

*Primary Examiner* — Steven A. Reynolds

(57) ABSTRACT

An airtight sheath, which includes at least two outer films being heat-sealed together, includes at least a first buffering body, and second and third buffering bodies respectively extending and bending from the first buffering body. The first buffering body includes a plurality of positioning columns and interference columns arranged in parallel with each other. Each of the interference columns is located between any two of adjacent positioning columns. Each of the positioning columns has two opposite end portions and a positioning portion between the two end portions, and each of the interference columns has two opposite end portions and an interference portion. The interference portion has a width in cross section less than a width of the positioning portion in cross section, whereby forming an insertion slot between the interference portion and the positioning portion for insertion of an external object.

8 Claims, 8 Drawing Sheets

AIRTIGHT SHEATH

BACKGROUND OF THE INVENTION

1. Field of the Invention

The present invention relates to a buffering sheath, and particularly to an airtight sheath being capable of securely positioning mobile devices therein.

2. Related Art

With the vigorous development of the technical industry, electronic and telecommunication products, such as smart phones, tablet computers and flat LCD TV sets, become more and more exquisite in terms of structure. For ensuring the integrity of these products throughout their packing, transport and delivery, packaging materials play an important role. In early days, foam and other soft, loose material were placed in cartons for providing buffering protection. However, their effects are limited as they are unable to be uniformly arranged and they tend to scatter around.

For overcoming the foregoing shortcomings, some packaging dealers started to use an inflatable air pack as cushioning material. Such an inflatable air pack has a piece-like shape constructed from a plurality of air columns, and is to be placed around an object to be protected or filled in a packaging box. However, one air pack can only protect one side of the object, and in order to achieve all-around protection, many of such air packs have to be used simultaneously. This nevertheless means troublesome installing operation. Furthermore, since the air packs are independent of each other, they tend to have displacement after the foregoing time-consuming installation, which results in collision and damage of objects inside. Particularly, with respect to electronic products, such as smart phones which are small in size and thickness, they are more vulnerable to collision attacks, that is to say the positioning of products to be packed is to be improved. On the other hand, cargos from manufactures are shipped out with cartons. The interior space of each carton should be perfectly used with installation of air packs in such a way that each product inside mush be well positioned and easily quickly packed so as to improve the efficiency of delivery and lower the labor and material management cost. Unfortunately, traditional packaging materials are not likely to fulfill aforementioned requirements.

SUMMARY OF THE INVENTION

Accordingly, an object of the present invention is to provide an airtight sheath, which has a positioning structure for quickly installation and securely positioning of products to be packed inside the airtight sheath.

Another object of the present invention is to provide an airtight sheath for providing products to be packet with multi-face protection from being attacked by external impact.

To achieve the above-mentioned objects, the airtight sheath, which is composed of at least two outer films being heat-sealed together, the airtight sheath comprises at least a first buffering body, comprising a plurality of positioning columns and interference columns being arranged in parallel with each other, two opposite sides of each of the positioning columns and the interference columns being heat-sealed to form heat-sealing lines and heat seal the two outer films; a second buffering body, extending from one side of the first buffering body and comprising a plurality of inflating columns, one end of each of the inflating columns being provided with a connecting node adjacent to each of the positioning columns and the interference columns for heat-sealing the outer films, so as to allow the plurality of inflating columns to bend inward with respect to the connecting nodes, and one end of the second buffering body far from the connecting nodes being provided with a connecting heat-sealing side for terminating the plurality of inflating columns; and a third buffering body, extending from another side of the first buffering body opposite to the second buffering body and comprising a plurality of inflating columns, one end of each of the inflating columns of the third buffering body being provided with a connecting node adjacent to each of the positioning columns and the interference columns for heat-sealing the outer films, so as to allow the plurality of inflating columns to bend inward with respect to the connecting nodes, one end of the third buffering body far from the connecting nodes being provided with a connecting heat-sealing side for terminating the plurality of inflating columns of the third buffering body, and at least an airflow channel formed in the first, second and third buffering bodies so as to allow inflating air to flow through the first, second and third buffering bodies, and an opening being formed between tops of the second and third buffering bodies; wherein each of the positioning columns of the first buffering body comprises two opposite end portions and a positioning portion between the two end portions, each of the interference columns comprises two opposite end portions and an interference portion between the two end portions, and the interference portion has a width in cross section less than a width of the positioning portion in cross section, whereby forming an insertion slot between the interference portion and the positioning portion and communicating with the opening for insertion of an external object.

In one aspect of the present invention, the two end portions of each of the positioning columns of the first buffering body respectively provided with bending nodes, the positioning portion of each of the positioning columns further defining a linking section and two bending sections located at opposite ends of the linking section and connecting the two end portions of the positioning column, the two bending sections respectively bending from the bending nodes, one side of each of the two bending sections being heat-sealed to the corresponding inflating column of the second and third buffering bodies such that the two bending sections are located between the linking section and the two end portions of the positioning column.

In another aspect of the present invention, the airtight sheath further comprises an additional said first buffering body, which is heat-sealed to the connecting heat-sealing side of the second buffering body, and is capable of rotating about the connecting heat-sealing side to cover the opening, so as to secure another end of the external object in the insertion slot of the additional said first buffering body.

The airtight sheath of the present invention utilizes the bending first buffering bodies at the top and bottom of the airtight sheath to form corresponding insertion slots for securely positioning the external object therein, whereby the positioning portion and the interference portion at two opposite sides of the insertion slot are capable of providing a horizontal positioning for the external object, while the inflating columns of the second and third buffering bodies are capable of providing a vertical positioning for the external object. Furthermore, two opposite ends of a bottom of the external object are well buffered by the two end portions of the interference column. As a result, the airtight sheath efficiently provides multidimensional protection for the external object during package and delivery from being damaged by external impact.

DESCRIPTION OF THE PREFERRED EMBODIMENTS

Figure 1:
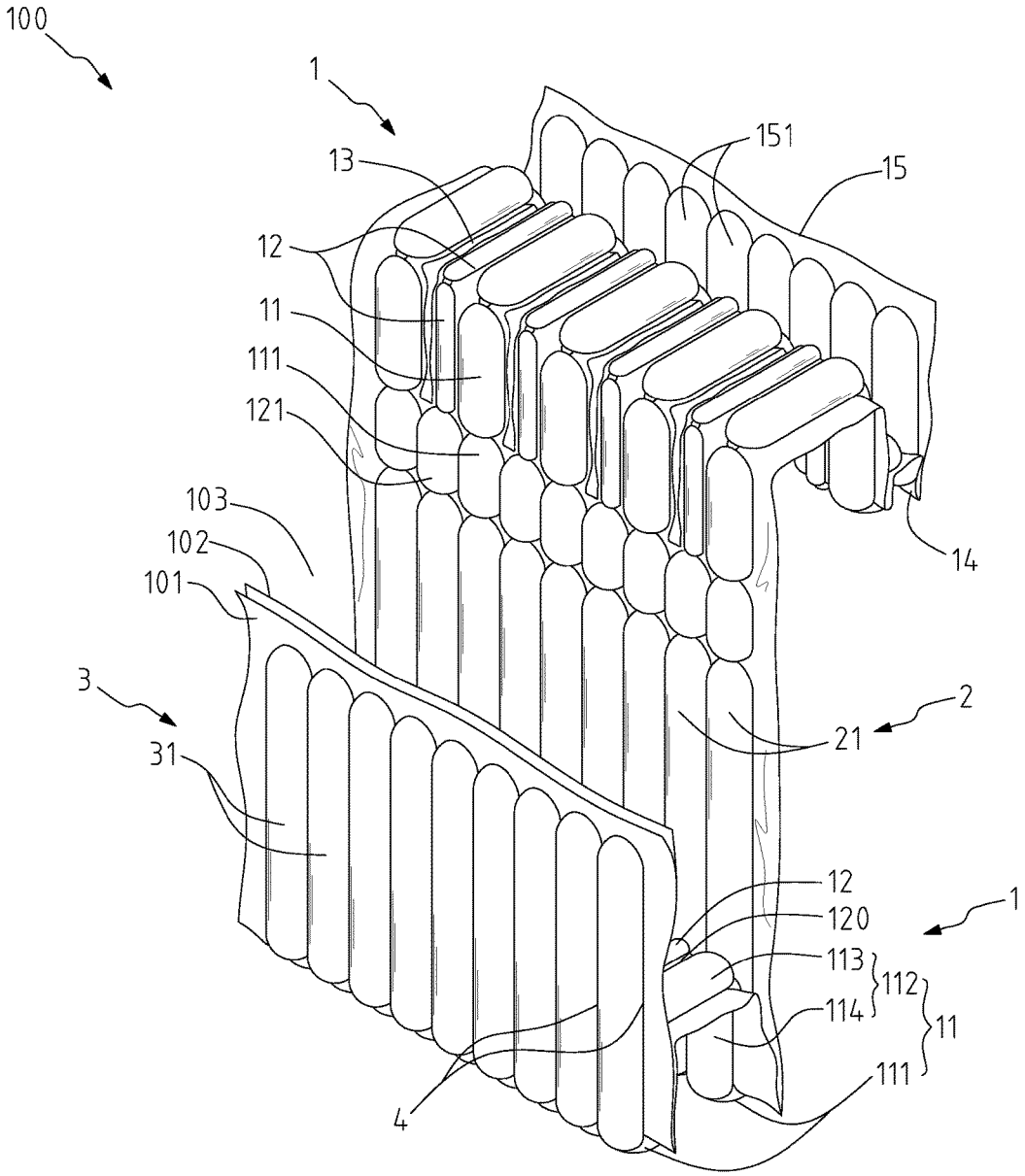
FIG. 1 is a perspective exploded view of an airtight sheath of the present invention.
Figure 2:
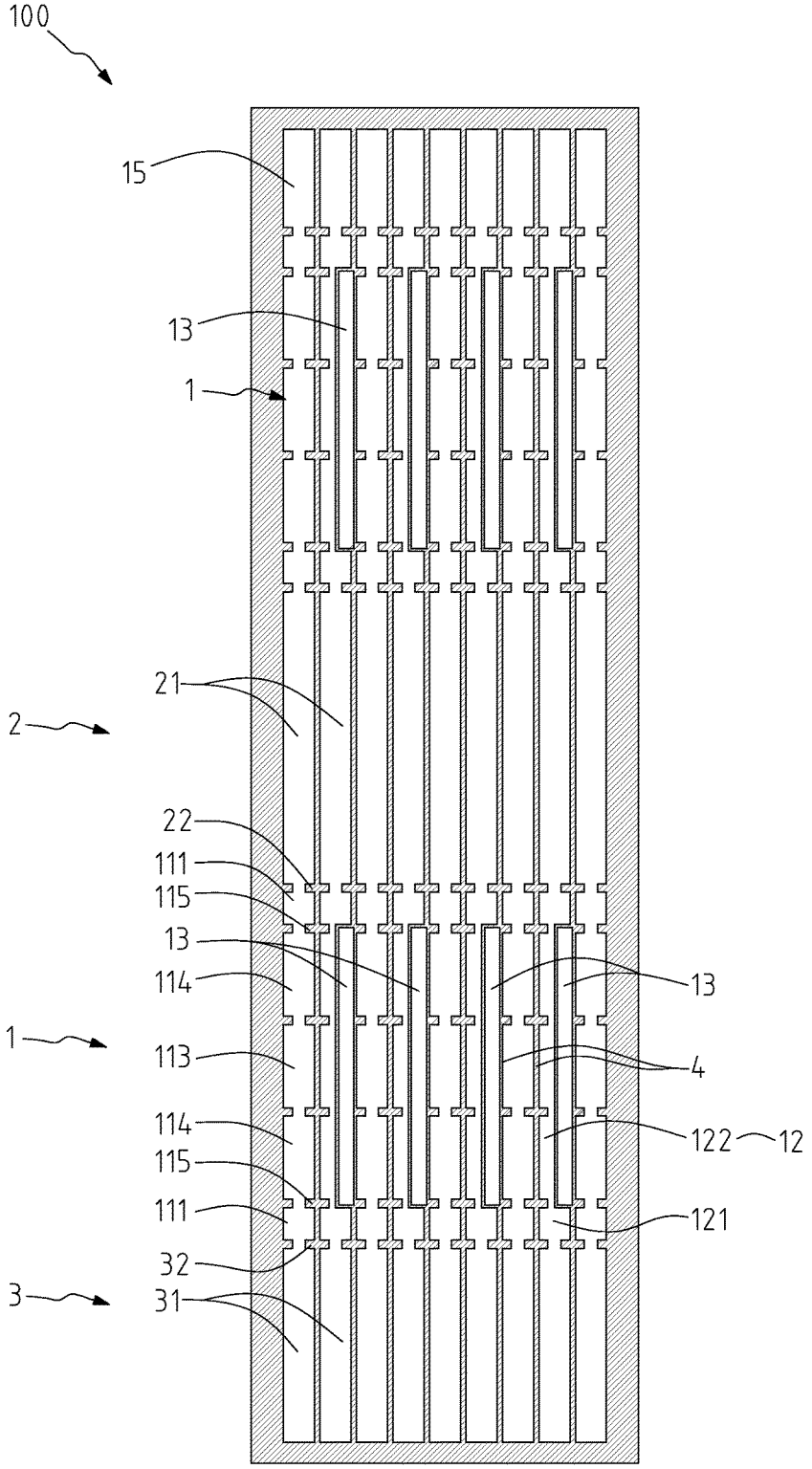
FIG. 2 is a schematic expanded view of FIG. 1.
Figure 3:
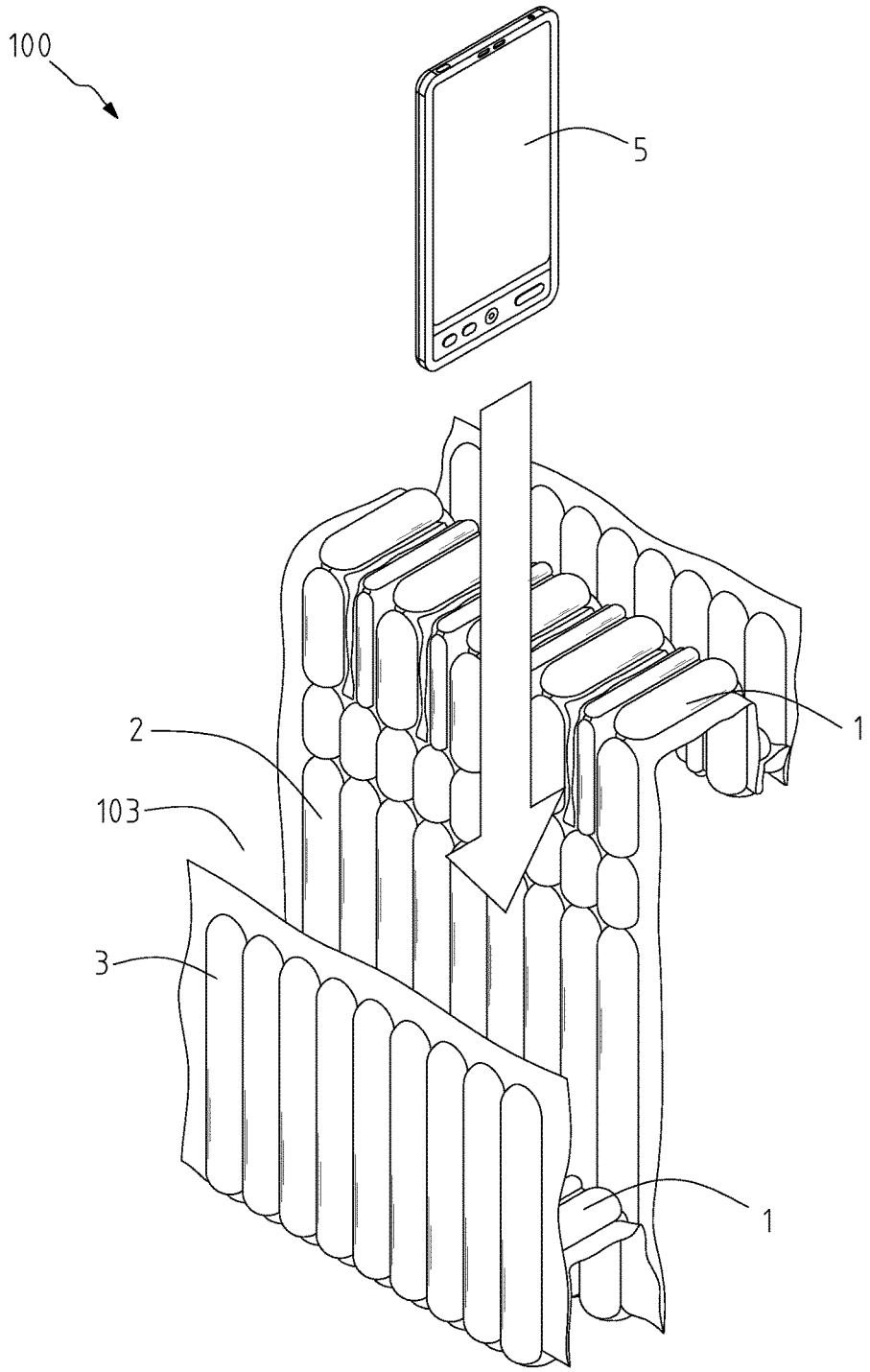
FIG. 3 is a schematic perspective view showing a mobile phone to be placed in the airtight sheath of the present invention.

The present invention discloses an airtight sheath 100, which is composed of at least two outer films 101 and 102 being heat-sealed together, and is capable of being rapidly inflated to form a three-dimensional buffering structure having positioning structure therein for buffering external impact.

Referring to FIGS. 1 to 6 illustrating a preferable embodiment of the present invention, the airtight sheath 100 comprises two first buffering bodies 1, a second buffering body 2 and a third buffering body 3. One of the first buffering body 1 is located at a bottom of the airtight sheath 100, while the other is located at a top of the airtight sheath 100. Each of the first buffering bodies 1 comprises a plurality of positioning columns 11 and interference columns 12 being arranged in parallel with each other. Each interference column 12 is located between two adjacent positioning columns 11. Two opposite sides of each of the positioning columns 11 and the interference columns 12 are heat-sealed to form heat-sealing lines 4 and thus heat seal the two outer films 101 and 102.

The second buffering body 2 extends from one side of the first buffering body 1 and comprises a plurality of inflating columns 21. One end of each of the inflating columns 21 is provided with a connecting node 22 adjacent to each of the positioning columns 11 and the interference columns 12 for heat-sealing the outer films 101 and 102, so as to allow the plurality of inflating columns 21 to bend inward with respect to the connecting nodes 22. One end of the second buffering body 2 far from the connecting nodes 22 is provided with a connecting heat-sealing side 20 for terminating the plurality of inflating columns 21.

The third buffering body 3 extends from another side of the first buffering body 2 opposite to the second buffering body 2 and comprises a plurality of inflating columns 31. One end of each of the inflating columns 31 of the third buffering body 3 is provided with a connecting node 32 adjacent to each of the positioning columns 11 and the interference columns 12 for heat-sealing the outer films 101 and 102, so as to allow the plurality of inflating columns 31 to bend inward with respect to the connecting nodes 32. One end of the third buffering body 3 far from the connecting nodes 32 is provided with a connecting heat-sealing side 30 for terminating the plurality of inflating columns 31. At least an airflow channel 41 is formed in the first, second and third buffering bodies 1, 2 and 3, so as to allow inflating air to flow through the first, second and third buffering bodies 1, 2 and 3. In this manner, the first, second and third buffering bodies 1, 2 and 3 cooperatively form a U shape in cross section, in which an accommodating space is formed for packing multiple external objects 5, for example, such as mobile phones. Furthermore, an opening 103 is formed between tops of the second and third buffering bodies 2 and 3 where the external objects 5 are to be packed inside the airtight sheath 100 from the opening 103. Particularly, the heat-sealing lines 4 of the first buffering body 1 at the bottom of the airtight sheath 100 respectively extend to the connecting heat-sealing lines 20 and 30 of the second and third buffering bodies 2 and 3; In other words, the first, second, and third buffering bodies 1, 2 and 3 are integrally heat-sealed together at one time through the heat-sealing lines 4.

Figure 4:
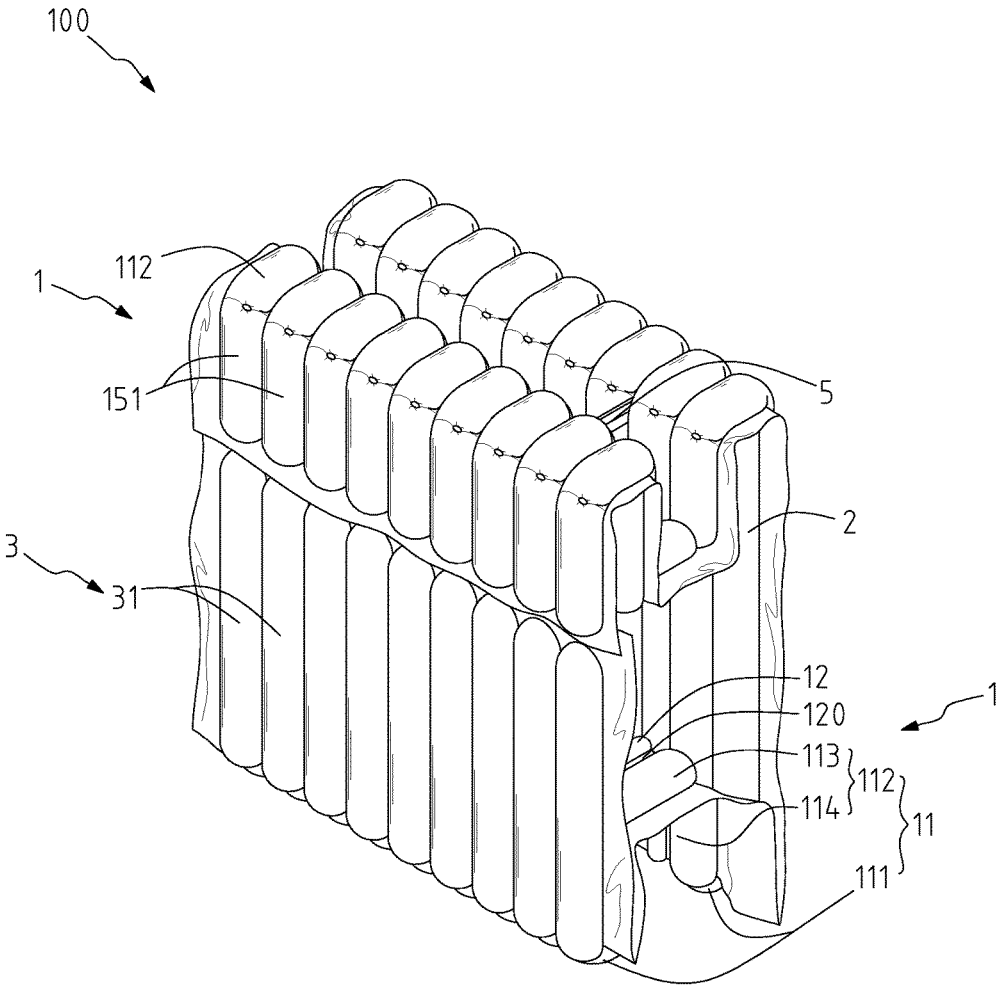
FIG. 4 is another perspective view showing the airtight sheath where an opening thereof is being covered.
Figure 5:
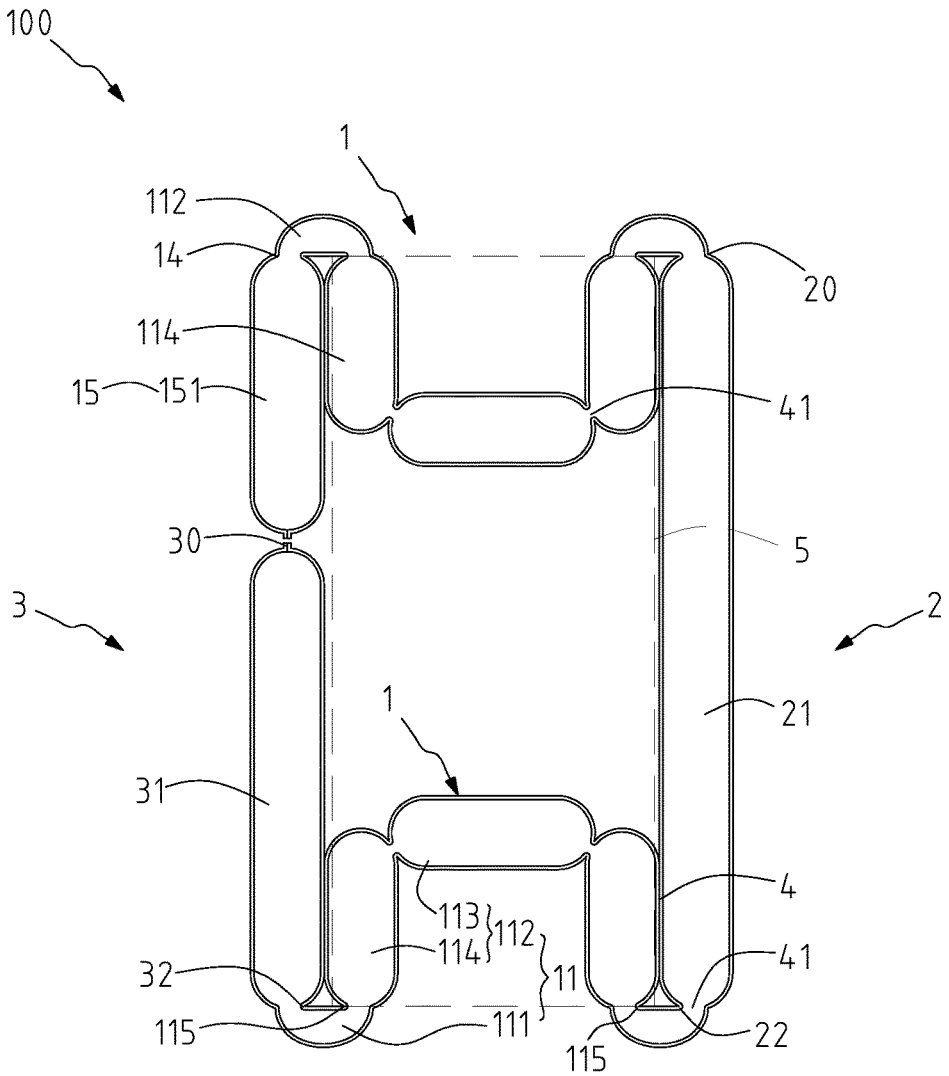
FIG. 5 is a schematic cross-sectional view of FIG. 4.
Figure 6:
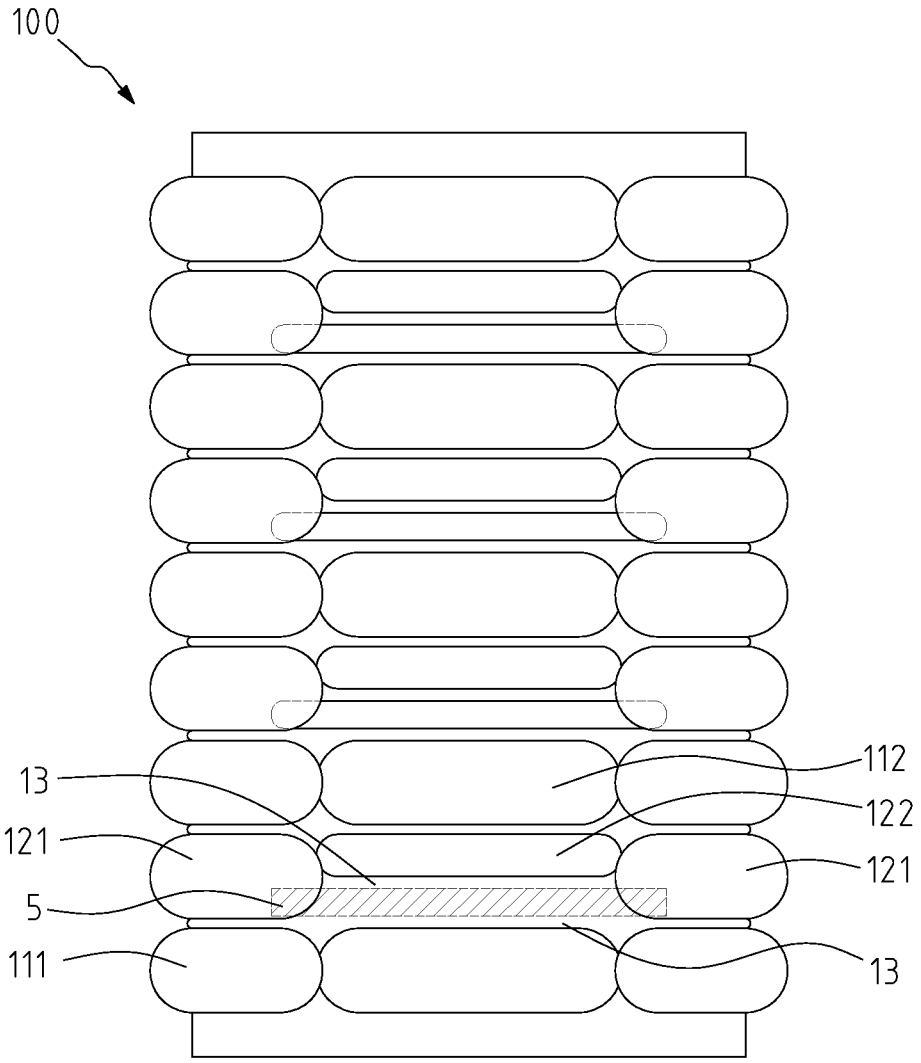
FIG. 6 is a top plan view of FIG. 4.

Referring to FIGS. 4 and 5, each of the positioning columns 11 of the first buffering body 1 comprises two opposite end portions 111 and a positioning portion 112 between the two end portions 111. Each of the interference columns 12 comprises two opposite end portions 121 and an interference portion 122 between the two end portions 121, and the interference portion 122 has a width in cross section less than a width of the positioning portion 112 in cross section, whereby forming an insertion slot 13 located between the interference portion 122 and the positioning portion 112 and communicating with the opening 103 for insertion of the external object 5. In order to securely position the external object 5 in the airtight sheath 100, the positioning columns 11 of the first buffering body 1 are respectively provided with bending nodes 115. The positioning portion 112 of each of the positioning columns 11 further defines a linking section 113 and two bending sections 114 connected to opposite ends of the linking section 113 and connecting the two end portions 111 of the positioning column 11. The two bending sections 114 respectively bend from the bending nodes 115, and one side of each of the two bending sections 114 is heat-sealed to the heat-sealing sides 4 of the corresponding inflating columns 21 and 31 of the second and third buffering bodies 2 and 3 such that the two bending sections 114 are located between the linking section 113 and the two end portions 111 of the positioning column 11 (as shown in FIG. 5). The positioning portion 112 has a reversed U shape with the bending of the bending sections 114. Particularly note that one side 120 of the interference portion 122 of the interference column 12 is entirely heat-sealed to the adjacent positioning column 11 (as shown in FIG. 1); in other words, the interference portion 122 has a reversed U shape corresponding to that of the positioning portion 112, and a depth of the insertion slot 13 is formed from a top of the linking section 113 to bottoms of the bending sections 114. In this manner, one end of the external object 5 abuts onto the two end portions 121 of the interference column 12 and to be clamped by the interference portion 122 and the positioning portion 112 after the external object 5 is being inserted into the insertion slot 13.

As described above, the first buffering body 1 at the top of the airtight sheath 100 is defined as an additional first buffering body 1, which is heat-sealed to the connecting heat-sealing side 20 of the second buffering body 2, and is capable of rotating about the connecting heat-sealing side 20 to cover the opening 103, so as to secure another end of the external object 5 in the insertion slot 13 of the first buffering body at the top of the airtight sheath 100. The first buffering body 1 at the top of the airtight sheath 100 has the same structure as the first buffering body 1 at the bottom. As a result, the external object 5 (i.e. a mobile phone) is capable of being securely positioned in the insertion slots 13 of the first buffering bodies 1 at the top and bottom of the airtight sheath 100.

Further referring to FIG. 5, a length of the third buffering body 3 in a longitudinal direction is less than that of the second buffering body 2. The first buffering body 1 on the opening 103 defines a top heat-sealing side 14 opposite to the connecting heat-sealing side 20. A perpendicular wall body 15 integrally extends from the top heat-sealing side 14 and comprises a plurality of inflating columns 151 that are located above the third buffering body 3 after the first buffering body 1 at the top of the airtight sheath 100 covers the opening 103. A sum of lengths of the perpendicular wall body 15 and the third buffering body 3 in the longitudinal direction is equal to a length of the second buffering body 2.

Figure 7:
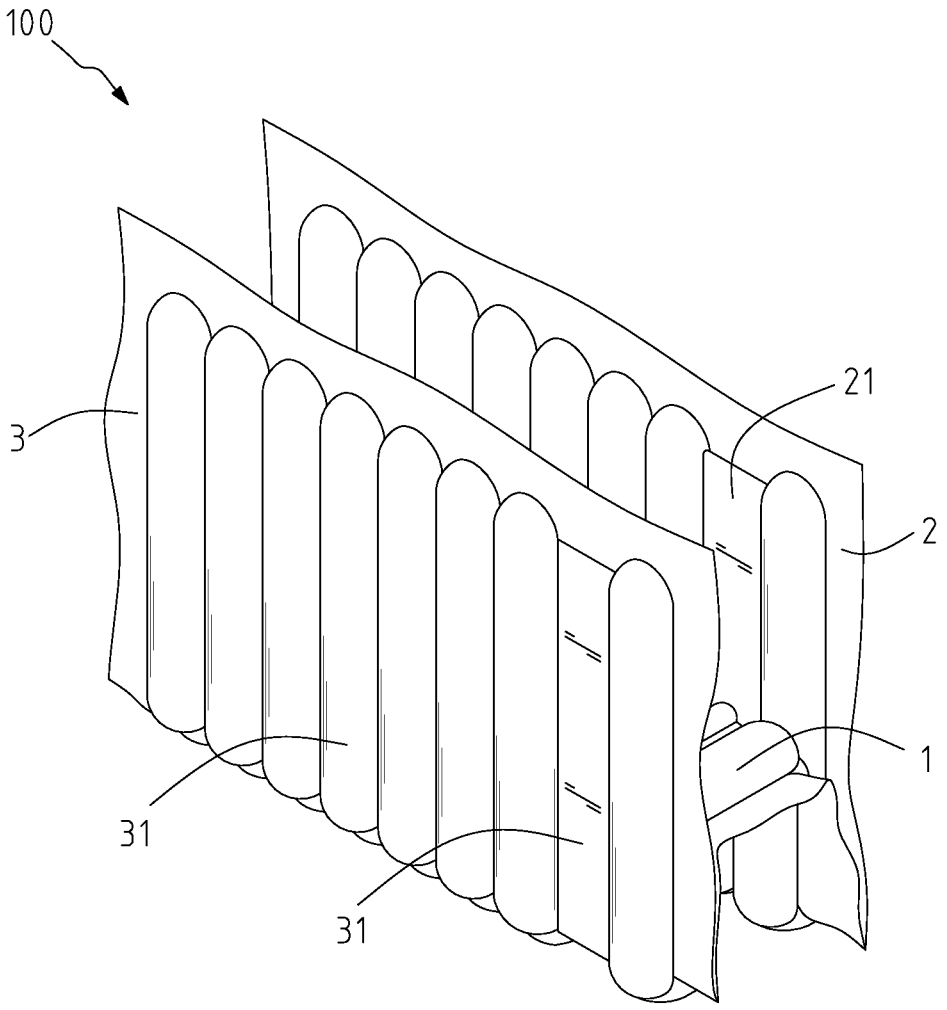
FIG. 7 is a perspective view showing another embodiment of the present invention.

Referring to FIG. 7 illustrating another embodiment of the present invention, the differences between this embodiment and the aforesaid embodiment are minor in the structure of the second and third buffering bodies 2 and 3. Specifically, at least one of the inflating columns 21 and of the second buffering body 2 and at least one of the corresponding inflating columns 31 of the third buffering body 3 are non-inflated, so as to fit different sizes of the external objects 5. Furthermore, in this embodiment, the top of the airtight sheath 100 is not provided with the first buffering body 1, where the airtight sheath 100 still can pack and position the external object 5 in the insertion slot 13.

Figure 8:
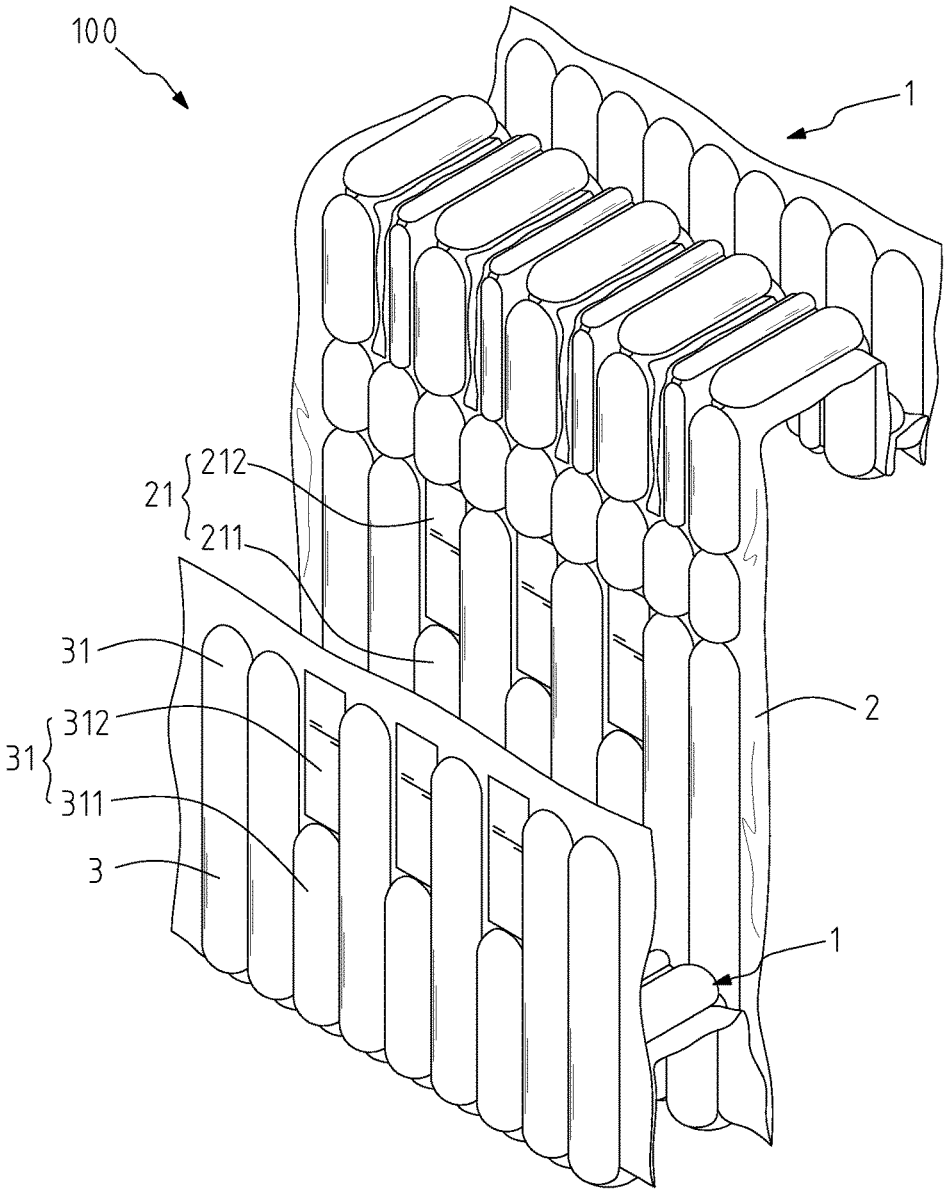
FIG. 8 is a perspective view showing another embodiment of the present invention.

Referring to FIG. 8 illustrating another embodiment of the present invention, the differences between this embodiment and the aforesaid embodiment are minor in the structure of the second and third buffering bodies 2 and 3. Specifically, at least one of the inflating columns of the second buffering body 2 or the third buffering body 3 includes an inflating section 211 or 311 and a non-inflating section 212 or 312 and is connected to a corresponding interference column 12 in order to fit different sizes of the external objects 5.

Accordingly, the airtight sheath 100 of the present invention utilizes the bending first buffering bodies 1 at the top and bottom of the airtight sheath 100 to form corresponding insertion slots 13 for securely positioning the external object 5 therein, whereby the positioning portion 112 and the interference portion 122 at two opposite sides of the insertion slot 13 are capable of providing a horizontal positioning for the external object 5, while the inflating columns 21 and 31 of the second and third buffering bodies 2 and 3 are capable of providing a vertical positioning for the external object 5. Furthermore, two opposite ends of a bottom of the external object 5 are well buffered by the two end portions 121 of the interference column 12. As a result, the airtight sheath 100 efficiently provides multidimensional protection for the external object 5 during package and delivery from being damaged by external impact.

It is understood that the invention may be embodied in other forms within the scope of the claims. Thus the present examples and embodiments are to be considered in all respects as illustrative, and not restrictive, of the invention defined by the claims.

What is claimed is:

1. An airtight sheath, which is composed of at least two outer films being heat-sealed together, the airtight sheath comprising:

at least a first buffering body, comprising a plurality of positioning columns and interference columns being arranged in parallel with each other, two opposite sides of each of the positioning columns and the interference columns being heat-sealed to form heat-sealing lines and heat seal the two outer films;

a second buffering body, extending from one side of the first buffering body and comprising a plurality of inflating columns, one end of each of the inflating columns being provided with a connecting node adjacent to each of the positioning columns and the interference columns for heat-sealing the outer films, so as to allow the plurality of inflating columns to bend inward with respect to the connecting nodes, and one end of the second buffering body far from the connecting nodes being provided with a connecting heat-sealing side for terminating the plurality of inflating columns; and a third buffering body, extending from another side of the first buffering body opposite to the second buffering body and comprising a plurality of inflating columns, one end of each of the inflating columns of the third buffering body being provided with a connecting node adjacent to each of the positioning columns and the interference columns for heat-sealing the outer films, so as to allow the plurality of inflating columns to bend inward with respect to the connecting nodes, one end of the third buffering body far from the connecting nodes being provided with a connecting heat-sealing side for terminating the plurality of inflating columns of the third buffering body, and at least an airflow channel formed in the first, second and third buffering bodies so as to allow inflating air to flow through the first, second and third buffering bodies, and an opening being formed between tops of the second and third buffering bodies;

wherein each of the positioning columns of the first buffering body comprises two opposite end portions and a positioning portion between the two end portions, each of the interference columns comprises two opposite end portions and an interference portion between the two end portions, and the interference portion has a width in cross section less than a width of the positioning portion in cross section, whereby forming an insertion slot between the interference portion and the positioning portion and communicating with the opening for insertion of an external object, the two end portions of each of the positioning columns of the first buffering body respectively provided with bending nodes, the positioning portion of each of the positioning columns further defining a linking section and two bending sections located at opposite ends of the linking section and connecting the two end portions of the positioning column, the two bending sections respectively bending from the bending nodes, one side of each of the two bending sections being heat-sealed to the corresponding inflating column of the second and third buffering bodies such that the two bending sections are located between the linking section and the two end portions of the positioning column.

2. The airtight sheath of claim 1, wherein one side of the interference portion is heat-sealed to the adjacent positioning column, so as to enable one end of the external object to abut onto the two end portions of the interference column and to be clamped by the interference portion and the positioning portion after the external object is being inserted into the insertion slot.

3. An airtight sheath, which is composed of at least two outer films being heat-scaled together, the airtight sheath comprising:

at least a first buffering body, comprising a plurality of positioning columns and interference columns being arranged in parallel with each other, two opposite sides of each of the positioning columns and the interference columns being heat-sealed to form heat-sealing lines and heat seal the two outer films;

a second buffering body, extending from one side of the first buffering body and comprising a plurality of inflating columns, one end of each of the inflating columns being provided with a connecting node adjacent to each of the positioning columns and the interference columns for heat-sealing the outer films, so as to allow the plurality of inflating columns to bend inward with respect to the connecting nodes, and one end of the second buffering body far from the connecting nodes being provided with a connecting heat-sealing side for terminating the plurality of inflating columns; and a third buffering body, extending from another side of the first buffering body opposite to the second buffering body and comprising a plurality of inflating columns, one end of each of the inflating columns of the third buffering body being provided with a connecting node adjacent to each of the positioning columns and the interference columns for heat-sealing the outer films, so as to allow the plurality of inflating columns to bend inward with respect to the connecting nodes, one end of the third buffering body far from the connecting nodes being provided with a connecting heat-sealing side for terminating the plurality of inflating columns of the third buffering body, and at least an airflow channel formed in the first, second and third buffering bodies so as to allow inflating air to flow through the first, second and third buffering bodies, and an opening being formed between tops of the second and third buffering bodies;

wherein each of the positioning columns of the first buffering body comprises two opposite end portions and a positioning portion between the two end portions, each of the interference columns comprises two opposite end portions and an interference portion between the two end portions, and the interference portion has a width in cross section less than a width of the positioning portion in cross section, whereby forming an insertion slot between the interference portion and the positioning portion and communicating with the opening for insertion of an external object, and the airtight sheath further comprises an additional said first buffering body, which is heat-sealed to the connecting heat-sealing side of the second buffering body, and is capable of rotating about the connecting heat-sealing side to cover the opening, so as to secure another end of the external object in the insertion slot of the additional said first buffering body.

4. The airtight sheath of claim 3, wherein a length of the third buffering body in a longitudinal direction is less than that of the second buffering body, the additional said first buffering body on the opening defining a top heat-sealing side opposite to the connecting heat-sealing side, a perpendicular wall body integrally extending from the top heat-sealing side and comprising a plurality of inflating columns that are located above the third buffering body after the additional said first buffering body covers the opening.

5. The airtight sheath of claim 4, wherein a sum of lengths of the perpendicular wall body and the third buffering body in the longitudinal direction is equal to a length of the second buffering body.

6. The airtight sheath of claim 1, wherein at least one of the inflating columns of the second buffering body and at least one of the corresponding inflating columns of the third buffering body are non-inflated.

7. The airtight sheath of claim 1, wherein at least one of the inflating columns of the second buffering body or the third buffering body includes an inflating section and a non-inflating section and is connected to a corresponding interference column.

8. The airtight sheath of claim 1, wherein the heat-sealing lines of the first buffering body respectively extend to the connecting heat-sealing sides of the second and third buffering bodies.

* * * * *